US005111007A

United States Patent [19]

Miller et al.

[11] Patent Number: 5,111,007

[45] Date of Patent: May 5, 1992

[54] SWITCH LOCK WITH LIGHTED POSITION INDICATOR

[75] Inventors: Charles D. Miller, Waukegan; Thomas J. DeCicco, Mt. Prospect; Timothy P. Laabs, Des Plaines, all of Ill.

[73] Assignee: The Eastern Company, Naugatuck, Conn.

[21] Appl. No.: 226,745

[22] Filed: Aug. 1, 1988

[51] Int. Cl.[5] ..... H01H 27/06; H01H 9/16

[52] U.S. Cl. ..... 200/43.08; 200/310; 70/432; 340/815.14; 116/286

[58] Field of Search ..... 200/43.08, 43.11, 317, 200/312, 310, 316, DIG. 47, 313, 43.04, 296; 70/432, 447, 448, 449, 450, 451, DIG. 59; 340/815.13, 815.12, 815.14, 815.15, 815.2, 825.31, 542, 543, 287; 116/202, 209, 286, DIG. 5; 174/DIG. 8

[56] References Cited

U.S. PATENT DOCUMENTS

| | | | |
|---|---|---|---|
| 1,145,206 | 7/1915 | Moore et al. | 70/210 |
| 1,213,845 | 1/1917 | Davenport | 219/201 |
| 1,328,072 | 1/1920 | Bechoff | 200/317 X |
| 1,554,048 | 9/1925 | Thomas | 200/43.08 |
| 1,702,483 | 2/1929 | Phelps | 200/61.68 |
| 2,081,827 | 5/1937 | Lohe | 200/317 |
| 2,215,162 | 9/1940 | Scott | 200/43.08 |
| 2,286,463 | 6/1942 | Chaskin | 346/568 |
| 2,793,522 | 5/1957 | Tornoe | 70/432 |
| 3,184,557 | 5/1965 | Clarey | 200/317 X |
| 3,550,410 | 12/1970 | Toepfer | 70/493 |
| 3,579,183 | 5/1971 | Lipschutz | 340/457 |
| 3,723,677 | 3/1973 | Arias | 200/43.04 |
| 3,824,539 | 7/1974 | Horvath | 200/43.04 |
| 4,262,507 | 4/1981 | Flack et al. | 70/432 |
| 4,683,741 | 8/1987 | Fields | 70/432 |

FOREIGN PATENT DOCUMENTS

| | | | |
|---|---|---|---|
| 2522210 | 11/1976 | Fed. Rep. of Germany | 200/316 |

OTHER PUBLICATIONS

Insulation Systems Inc.; No Heat Shrink Tubing and Tape, 1976.

*Primary Examiner*—Ernest G. Cusick
*Assistant Examiner*—Glenn T. Barrett
*Attorney, Agent, or Firm*—Wood, Phillips, VanSanten, Hoffman & Ertel

[57] ABSTRACT

A switch lock is provided including a lock plug rotatable by a key between two or more positions within a lock barrel, and a switch is associated therewith such that one switch pole is selectively placed in one or more positions by the plug. A visual switch position indicator includes a second switch pole in the switch with a power source connected thereto, and an LED visible from the lock forward end has its leads connected to a terminal for selective connection to a power source in response to the position of the lock plug. The LED leads are flexible, disposed in a groove in the rear face of the lock bezel, and pass through a space between the lock barrel and the opening in the mounting plate. The switch wires are fixed to a connector and are protected by a shrink tube over the switch.

15 Claims, 2 Drawing Sheets

FIG. 1
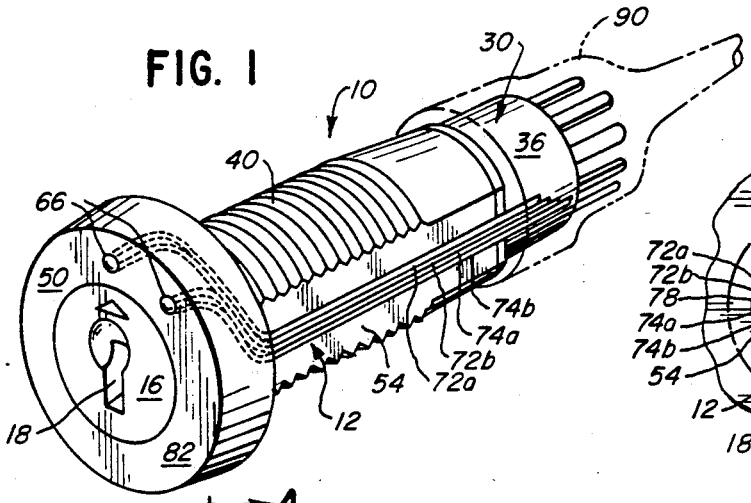
FIG. 4
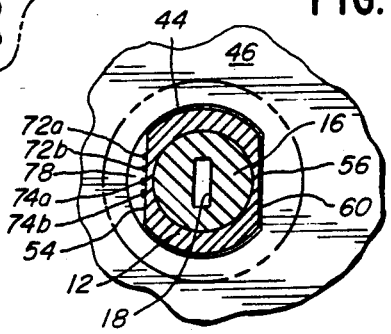
FIG. 3
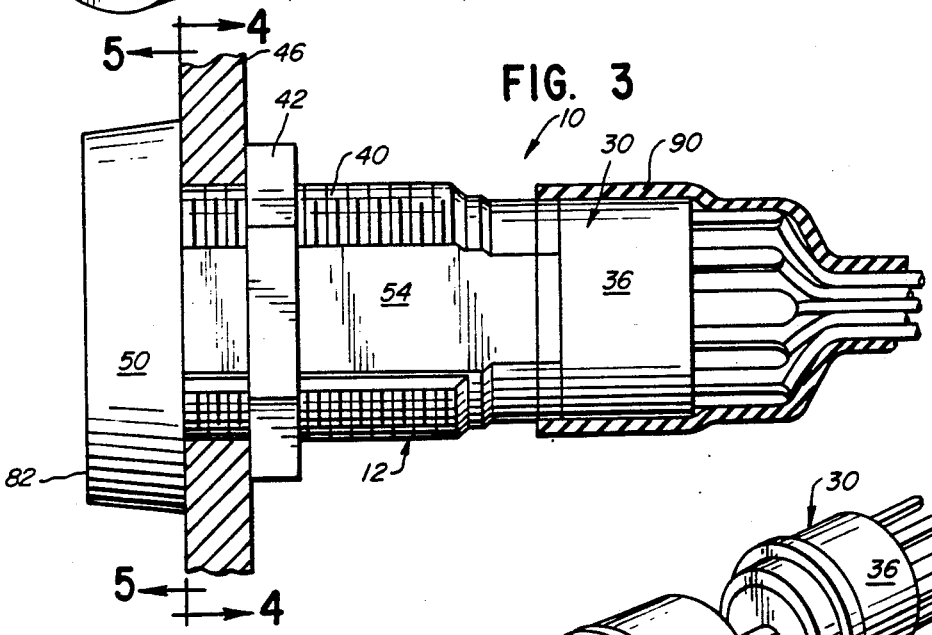
FIG. 2
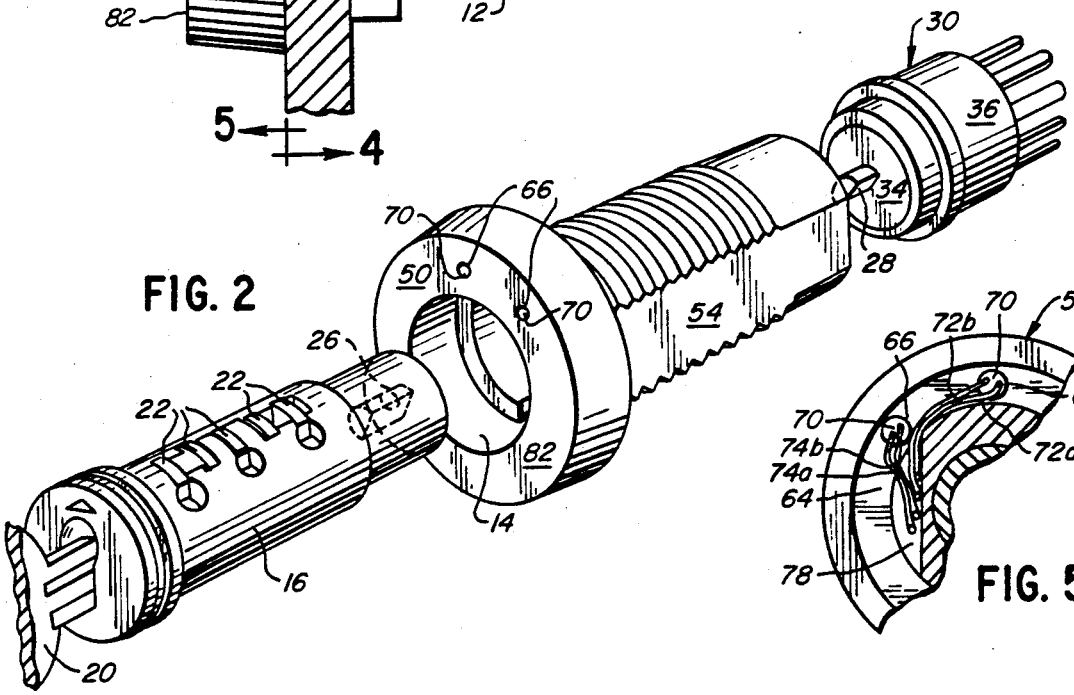
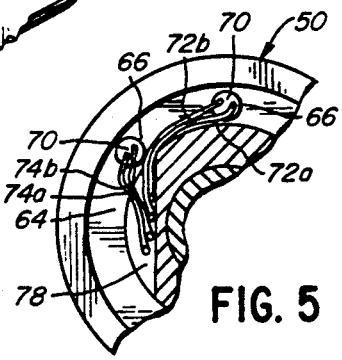
FIG. 5

FIG. 6
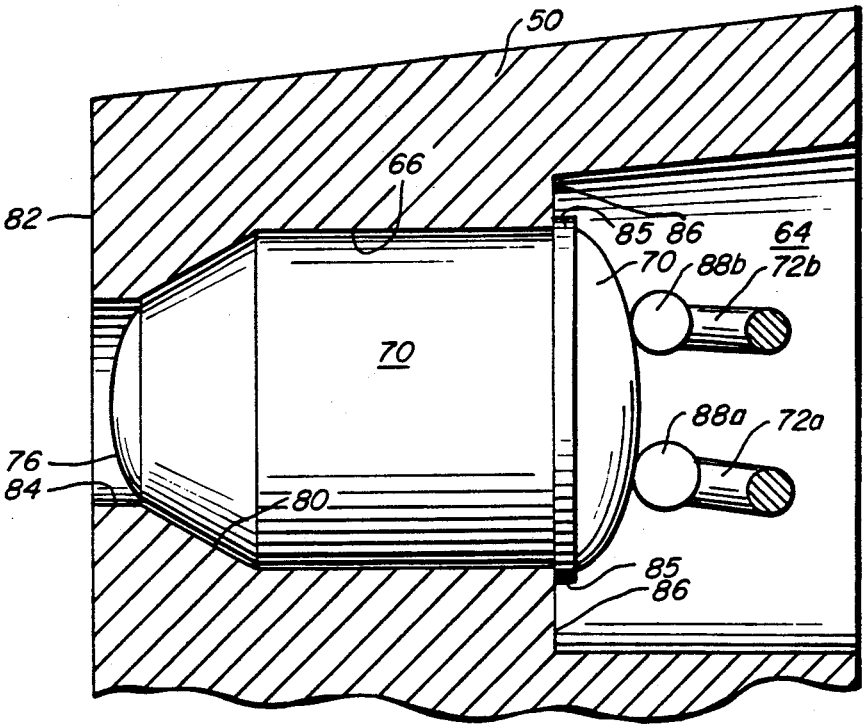
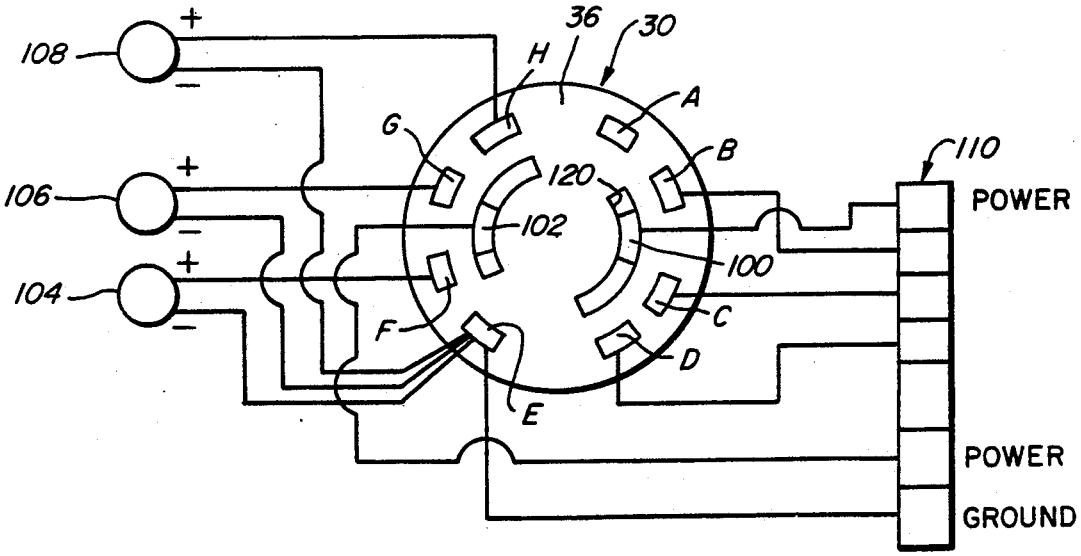
FIG. 7

SWITCH LOCK WITH LIGHTED POSITION INDICATOR

TECHNICAL FIELD

The present invention relates to a key lock having lighted lock position indicators.

BACKGROUND OF THE INVENTION

Switch locks are known in the art including key locks (with a rotatable plug and tumblers) which are used to control use of an electrical switch. Such switch locks can be used, for example, to limit access to a computer or other electronic device by requiring that only a person with a key be able to turn on the power to the device. Wolniak et al. U.S. Pat. Nos. 4,405,843, 4,427,852, 4,566,167, 4,633,689 and 4,689,977, the disclosures of which are hereby incorporated by reference, illustrate various types of such switch locks.

In many instances, it is desirable to provide some readily noticeable indication of the position of the key lock. By making an operator more likely to notice when the lock is in, for example, a "power on" position, inadvertent breaches of security can be minimized.

A few locks with indicators have been proposed in the past. For example, devices have included a single light to indicate either one lock position (Moore et al. U.S. Pat. No. 1,145,206) or presence of the key in the lock (Thomas U.S. Pat. No. 1,544,048, in which removal of the key is prevented unless the lock is in a particular position).

Chaskin U.S. Pat. No. 2,286,463 shows a door lock provided with two lamps, one of which will be illuminated (only when the key is inserted) to indicate whether the door is locked or unlocked. A clumsy mechanical structure switches between the two lamps.

SUMMARY OF THE INVENTION

In one aspect of the present invention, a lock has a rotary member mechanically coupled to a rotary switch for rotation therewith. The switch has a first pole and a first contact associated therewith for switching leads to a first set of load circuits in accordance with the position of the rotary member. A position indicator includes an indicator light, a second switch pole pivoting with the first switch pole, and a second contact associated with the second switch pole. The second contact is connected to the light to complete a second circuit to the light in one position of the rotary lock member and switch.

In another aspect of the present invention, the switch poles and contacts have leads secured to a common connector adapted to connect the first switch pole leads to load circuits and to connect the second switch pole leads to power and ground lines.

In still another aspect of the present invention, a protective boot formed by a shrink tube is provided over the switch and the leads.

In yet another aspect of the present invention, the indicator light is mounted in a hole in a bezel secured to a lock barrel, and the bezel is seated against a mounting surface. The hole has a reduced diameter at the front of the lock whereby the light is recessed behind the front surface of the bezel.

In a further aspect of the present invention, the indicator light is a LED and the bezel includes a well or groove in its rear surface receiving flexible leads of the LED.

In still another aspect of the present invention, the barrel has two flat sides and extends through a circular opening in the mounting surface having one flat side. The opening has its flat side associated with the one barrel flat side, and the light leads extending from the bezel well to the rear of the mounting surface through a space between the barrel other flat side and the opening.

In another aspect of the present invention, a second indicator light is provided, and a second contact is associated with the second switch pole. The second contact is connected to the second light to complete a second circuit to illuminate the second light in a second position of the rotary lock member and switch.

The present invention provides a switch lock with a visual indication of the lock position, such indication being readily observable at a distance from the lock itself. The present invention thus will minimize the possibility of inadvertent breaches of the security provided by the lock.

The present invention further provides a visual position indicator which may be easily used with switch locks having many different configurations. Still further, switch locks embodying the present invention may be easily and inexpensively manufactured, and further can be quickly and easily installed in new locations and retrofitted in many existing switch lock installations.

The present invention provides a structure whereby the multiple leads required for the lights and the circuitry do not interfere with normal, secure installation of the lock, and whereby the leads are further securely mounted and may be easily connected to existing circuitry with which switching is desired.

BRIEF DESCRIPTION OF THE DRAWINGS

FIG. 1 is a perspective view of a switch lock of the present invention, showing the protective boot in phantom:

FIG. 2 is an exploded perspective view of the switch lock of FIG. 1 with lamp leads omitted;

FIG. 3 is a side view in partial cross-section of the switch lock mounted on a plate with lamp leads omitted;

FIG. 4 is a cross-sectional view of the switch lock along line 4—4 of FIG. 3;

FIG. 5 is a fragmentary cross-sectional view of the switch lock along line 5—5 of FIG. 3;

FIG. 6 is an enlarged cross-sectional view through the lock bezel opening in which a light is mounted; and FIG. 7 is a diagram of the electrical circuitry of the switch.

DESCRIPTION OF THE PREFERRED EMBODIMENT

A switch lock 10 embodying the present invention is shown best in FIGS. 1–3. Specifically, the switch lock 10 includes a lock barrel 12 having a central opening 14 in which a lock plug 16 is secured for rotation.

The lock plug 16 includes a key slot 18 into which an appropriately bitted key 20 (see FIG. 3) may be inserted to retract the tumblers 22 to provide clearance from splines (not shown) in the barrel 12 to allow for rotation of the plug 16 and withdrawal of the key 20. Further details of this structure are not shown in detail in the figures, as such lock plug and barrel combinations are well known in the art, and any lock/barrel configuration providing suitable key operation for rotation would be usable with the present invention, as will become apparent from the description set forth below.

The rear end of the plug 16 includes a D-shaped hole 26 into which a D-shaped stem 28 of the switch 30 extends to ensure that the plug 16 and the switch rotary member 34 rotate together. The outer housing 36 of the switch 30 is suitably secured to the lock barrel 12 so that it does not rotate.

A suitable detent (not shown) may be included in the switch 30 to provide a positive feel when switching between positions.

The barrel 12 includes a threaded portion 40 over which a nut 42 is screwed to secure the barrel 12 in an opening 44 in the barrier or plate 46 to which it is mounted. As best shown in FIG. 3, the barrier 46 is secured between the nut 42 and the bezel 50 on the forward end of the barrel 12.

With conventional locks, the barrier opening is generally round with two flat sides or sectors matching the flat sides 54, 56 of the barrel 12 (see FIG. 4) to prevent rotation of the barrel 12 in the barrier 46. With the present invention, however, the barrier opening or application hole 44 is round except for a single flat side or sector 60 (see FIG. 4). This mounting structure not only ensures that the lock barrel 12 will not undesirably rotate in the barrier 46, it also provides a clearance for wires as will become apparent.

The barrel bezel 50 has a groove or well 64 in its rear surface (see FIG. 5) extending between openings 66 through the bezel. Suitable lights or lamps 70 are mounted in the openings 66 to provide the desired visual indication to the front of the lock 10. Light emitting diodes (LEDs) provided with insulated, flexible leads 72*a–b*, 74*a–b* have been found to be particularly suitable for use as such lamps 70. LEDs are inexpensive, unbreakable, produce minimal heat, have unlimited life, and allow use of smaller leads 72*a–b*, 74*a–b* than incandescent lamps.

Where different colors are desired, the LEDs 70 having translucent domes 76 of the desired colors may be used (see FIG. 6). 30 The flexible leads 72*a–b*, 74*a–b* of the LEDs 70 follow a path through the well 64 to the space 78 between the one flat barrel side 54 and the round barrier opening 44. This allows the leads 72*a–b*, 74*a–b* to extend to the area behind the barrier 46 (which area is generally the interior of a housing and thus protected) while at the same time allowing the bezel 50 to securely seat on the barrier 46 to provide complete security for the lock 10 and its leads 72*a–b*, 74*a–b*.

The bezel openings 66 may be configured as shown in FIG. 6 to protect the LEDs 70 from damage. Specifically, the opening 66 contains a rearwaredly tapered portion 80 which is set behind the front face 82 of the bezel 50 by a cylindrical portion 84. This cylindrical portion 84 ensures that the openings 66 as viewed from the front face 82 remain round even after the surface is slightly worn down by polishing of the front face 82 before assembly with the LEDs 70.

The above configuration of the bezel openings 66 also secures the domes 76 of the LEDs 70 so that their forwardmost portion is offset behind the bezel front face 82, thereby protecting them from damage, for example, when the bezel front face 82 is cleaned or polished after assembly.

The LEDs 70 further have a flange 85 about the periphery of their rear end (see FIG. 6) which seats upon a shoulder 86 in the bezel 50 to provide for a secure mounting therein. This flange 85 further ensures that the solder 88*a–b* of the flexible leads 72*a–b* to the LEDs 70 does not contact the sides of the well 64 (which contact would short out the circuit to the LED 70).

As shown in FIGS. 1 and 3, a protective boot 90 may be provided over the switch 30 and its associated wiring, to provide the switch lock 10 with security against any of its wires being inadvertently broken off of their associated terminals (discussed below) during transport or installation. The boot 90 further ensures that no hot wires or soldering in the switch 30 are exposed.

The protective boot 90 may be formed of a suitable shrink tube or the like. Further, in a switch lock 10 having significantly smaller diameter at the rear of the switch 30 than the diameter at its forward end, the shrink tube can be doubled over at its rear end if necessary to ensure a tight fit of the boot 90 over the switch 30 and wiring.

The switch 30 includes two poles 100, 102 (see FIG. 7), one pole 100 being the primary pole providing the main operation desired (such as switching between power for a first device, power for a second device, and power off) and the other pole 102 operating secondarily, that is, to control the three indicating lamps or LEDs 104, 106, 108 shown in the FIG. 7 embodiment. This embodiment is usable with a three position lock, with each lamp indicating one of three positions.

More specifically, the switch 30 has eight terminals A–H, four of the terminals A–D being associated with the primary pole 100 and the other four terminals E-H being associated with the secondary pole 102.

The terminals B–D and their associated primary pole 100 are suitably connected to a terminal unit or common connector 110 which eases connection with the circuitry to be controlled by the switch lock 10. Terminals E–H and their associated secondary pole 102 are similarly connected to the connector 110. The connector 110 thus further protects the wiring of the switch 30 by eliminating any need for the user to do any soldering in the switch 30.

Rotation of the lock plug 16 rotates the primary pole 100 (which moves in the slot 120 in the switch housing 36), which movement brings the pole 100 into suitable electrical contact with a selected one of the terminals A-D (by, e.g., moving a radially extending lead [not shown] of the pole 100 into physical contact with the selected terminal B, C, or D). Inasmuch as the pole 100 is connected to power, connection to any terminal B, C, or D supplies power to the device connected with that terminal.

Of course, it should be understood that the power and ground lines could be reversed, with the pole 100 providing the ground to complete the circuit.

The secondary pole 102 operates in essentially the same manner as the primary pole 100, except that the connection of the secondary pole 102 with a selected one of its terminals F, G, or H results in power being provided to illuminate the indicator lamps 104, 106, 108 associated therewith (i.e., connection to terminal F illuminates lamp 104, terminal G illuminates lamp 106, and terminal H illuminates lamp 108).

Since the primary pole 100 rotates with the secondary pole 102, the two poles 100, 102 will simultaneously switch power. Thus, either lamp 104 and the device associated with terminal B will be powered, or lamp 106 and the device associated with terminal C will be powered, or lamp 108 and the device associated with terminal D will be powered.

It will be apparent that the structure of the present invention can be used with barrel/plug combinations having a variety of configurations, including locks having more than two positions, locks using multiple keys having different bittings to provide only partial security access to the key holder, and whether or not the lock allows the key 20 to be withdrawn from its slot 18 in all such positions.

As will also be apparent to the skilled artisan, simple variations of the above structure could be made to utilize this indicator lamp invention with locks having any variety of configurations, with one, two, three or even more lamps. Such switch locks will provide reliable visual indications of the position of the lock, which indications are readily observable at a distance from the lock to minimize inadvertent breaches of security. Further, the above described lock can be readily and inexpensively manufactured, and easily installed in either new or retrofit installations. Still further, the above described switch lock provides secure mounting of the many leads associated with switch locks to protect against both accidental and intentional damage thereto, and further allows such leads to be easily connected to existing circuitry with which switching is desired.

Other aspects, objects, and advantages of the present invention can be obtained from a study of the specification, drawings and appended claims.

We claim:

1. In a switch lock having a forward end and a rearward end and mounted in a barrier opening, said switch lock having a lock plug rotatable between two positions and a switch rotated by the lock plug between two positions to place a primary switch pole in a selected one of two positions, a visual switch position indicator, comprising:

a secondary switch pole having two positions, said secondary switch pole being connected to a power source;

a first light indicating a first position of said switch lock, said first light having leads, one of said leads being connected to ground;

a second light indicating a second position of the switch lock, said second light having leads, one of said leads being connected to ground;

a bezel at the lock forward end, said bezel having a front surface and a rear surface and mounting the lights in openings therethrough and having its rear surface supported against the barrier;

a groove in the bezel rear surface between the light openings, wherein said light leads are secured in said groove; and three switch terminals, one of said terminals being connected to ground, the second of said terminals being connected to the other lead of the first light and selectively connected to the secondary switch pole in response to rotation of the switch to complete a power circuit to illuminate the light to indicate the first position of the lock plug, and the third of said terminals being connected to the other lead of the second light and selectively connected to the secondary switch pole in response to rotation of the switch to complete a power circuit to illuminate the light to indicate the second position of the lock plug.

2. A position indicator for a rotary lock having a barrel with a bezel, the lock being mounted on a plate having a front and a rear and said barrel extending through a hole in the plate and the bezel seated on the front of the plate, comprising:

first and second lamps in the bezel;

a rotary switch on the barrel behind the plate and actuated by the rotary lock, the hole in the plate being larger than the lock barrel, said rotary switch having a first switch pole controlling load circuits, and a second switch pole illuminating one of the lamps when one of the load circuits is closed; and leads connecting the lamps with the switch and extending outside the barrel through the hole in the plate;

wherein said first lamp is illuminated when said rotary lock and switch are in a first position, and said second lamp is illuminated when said rotary lock and rotary switch are in a second position.

3. The lock of claim 2, wherein said bezel includes a well in its rear surface receiving the leads of said first and second lamps.

4. The lock of claim 3, wherein the lamps are LEDs with flexible leads.

5. A lock for switching electric loads, comprising:

a lock with a rotary member;

a rotary switch mechanically coupled to the rotary member for rotation therewith, said switch having first and second poles which rotate between first and second positions together with said switch;

a first contact connected to said first switch pole when the rotary member and switch are in the first position to complete a first load circuit;

a second contact connected to said first switch pole when the rotary member and switch are in the second position to complete a second load circuit; and a position indicator having first and second indicator lights, a third contact connected to the first light, said third contact further being connected to the second switch pole when the rotary member and switch are in the first position to complete a first light circuit, and a fourth contact connected to the second light, said fourth contact further being connected to the second switch pole when the rotary member and switch are in the second position to complete a second light circuit.

6. The lock of claim 5, wherein the indicator lights have leads and are mounted in a holes in a bezel of a lock barrel within which said rotary member rotates, said bezel having a front surface and a rear surface with said bezel rear surface being seated against a mounting surface.

7. The lock of claim 6, wherein said bezel includes a well in its rear surface receiving leads of said indicator lights.

8. The lock of claim 7, wherein said barrel has two flat sides and extends through a cylindrical opening in the mounting surface having one flat side, said opening having its flat side associated with one flat side of the barrel, and said light leads extending from the well to the rear of the mounting surface through a space between the barrel other flat side and the opening.

9. A switch lock having a position indicator, comprising:

a switch;

a rotary member mechanically coupled to the rotary switch for movement therewith;

a lock barrel within which said rotary member rotates, said barrel having a bezel with a front surface and a rear surface with said bezel rear surface having a well therein and being seated against a front portion of a mounting surface, and two flat sides on said barrel, wherein said barrel extends through a mounting surface cylindrical opening having one flat side associated with one flat sides of the barrel; and a position indicator having an indicator light secured to the bezel and having leads connected to the rotary switch, said switch being operable to complete a light circuit in one position of the rotary member and switch, whereby said light leads extend from the well to the rear of the mounting surface through a space between the barrel other flat side and the opening.

10. In a switch lock having a forward end and a rearward end and having a lock plug rotatable between three positions with a lock barrel, a key being inserted from the lock forward end, and said lock plug further rotating a switch between three positions to place a first switch pole in a selected one of three positions, a visual switch position indicator, comprising:

a second switch pole operated with the first switch pole and having three positions;

a power source connected to the second switch pole; and first, second, and third lights visible from the lock forward end, each of said lights having one lead connected to ground and a second lead connected to a separate terminal, said second switch pole being selectively connected to one of said terminals responsive to the position of the lock plug.

11. The switch lock of claim 10, wherein the lock is mounted in a barrier opening and further comprising:

a bezel at the lock forward end, said bezel having a front surface and a rear surface and mounting the lights in openings therethrough and having its rear surface supported against the barrier; and a groove in the bezel rear surface between the lights openings, wherein said light leads are secured in said groove.

12. A position indicator for a rotary lock having a barrel with a bezel, the lock being mounted on a plate having a front and a rear and said barrel extending through a hole in the plate and the bezel seated on the front of the plate, comprising:

a lamp in the bezel;

a rotary switch on the barrel behind the plate and actuated by the rotary lock, the hole in the plate being larger than the barrel; and a wire connecting the lamp with the switch and extending outside the barrel through the hole in the plate, said barrel having a round cross-section with a flat sector and the plate hole being round to accommodate the wire extending along the flat sector on the barrel.

13. A switch lock, comprising:

a lock barrel having a bezel, said bezel having a front surface and a rear surface with said bezel rear surface being seated against a mounting surface;

a lock with a rotary member rotatable in the lock barrel;

a rotary switch mechanically coupled to the rotary member for rotation therewith, said switch having first and second poles and a contact associated with said first pole for switching loads in accordance with the position of the rotary member; and a position indicator having an indicator light having leads, said light being mounted in a hole in the bezel, a well in the bezel rear surface for receiving the leads of said indicator light, and a first contact associated with said second switch pole and connected to the light to complete a light circuit in one position of the rotary member and switch.

14. The lock of claim 13, wherein the indicator light is an LED and the LED leads are flexible.

15. A switch lock, comprising:

a lock barrel having a bezel, said bezel having a front surface and a rear surface with said bezel rear surface being seated against a mounting surface;

a lock with a rotary member rotatable in the lock barrel;

a rotary switch mechanically coupled to the rotary member for rotation therewith, said switch having first and second poles and a contact associated with said first pole for switching loads in accordance with the position of the rotary member; and a position indicator having an indicator light mounted in a hole in the bezel, said hole having a reduced diameter at the front of the lock ensuring that the light is recessed behind the front surface of the bezel, and a first contact associated with said second switch pole and connected to the light to complete a light circuit in one position of the rotary member and switch.

* * * * *